US005291658A

United States Patent [19]

Wilson et al.

[11] Patent Number: 5,291,658

[45] Date of Patent: Mar. 8, 1994

[54] CAN OPENER

[75] Inventors: Leslie P. S. Wilson, London; David Anderson, Sun; David M. Raffo, Chester, all of England

[73] Assignee: Prestige Group UK PLC, Surrey, England

[21] Appl. No.: 849,759

[22] Filed: Mar. 12, 1992

[30] Foreign Application Priority Data

| | | | |
|---|---|---|---|
| Mar. 13, 1991 | [GB] | United Kingdom | 9105347 |
| Oct. 14, 1991 | [GB] | United Kingdom | 9121762 |
| Oct. 28, 1991 | [GB] | United Kingdom | 9122804 |
| Jan. 26, 1992 | [GB] | United Kingdom | 9201646 |

[51] Int. Cl.[5] ..... B67B 7/46

[52] U.S. Cl. ..... 30/418; 30/422

[58] Field of Search ..... 30/440, 420, 422, 418, 30/417

[56] References Cited

U.S. PATENT DOCUMENTS

| | | | |
|---|---|---|---|
| 1,583,934 | 5/1926 | Leggett | 30/418 |
| 1,825,216 | 9/1931 | Thybony et al. | 30/417 |
| 1,973,338 | 9/1934 | Fawkes | 30/420 |
| 2,606,363 | 8/1952 | Hartman et al. | 30/417 |
| 2,718,056 | 9/1955 | Burnett | 30/422 |
| 4,365,417 | 12/1982 | Rosendahl | 30/422 |
| 5,022,159 | 6/1991 | Cressman et al. | 30/418 |
| 5,121,546 | 6/1992 | Chong | 30/418 |

FOREIGN PATENT DOCUMENTS

| | | |
|---|---|---|
| 0202790 | 11/1986 | European Pat. Off. . |
| 471034 | 4/1969 | Switzerland . |
| 2161449 | 1/1986 | United Kingdom . |

*Primary Examiner*—Richard K. Seidel
*Assistant Examiner*—Hwei-Siu Payer
*Attorney, Agent, or Firm*—Larson and Taylor

[57] ABSTRACT

A can opener includes a pair of pivoted handle members (101), (102), associated with a drive wheel (108) and a cutting wheel (111), which are brought into a position to nip the rim of a can when the handles are closed. The nip on the can is not lost when the handle members are partially opened to an intermediate position. As shown the cutting wheel is pivotally mounted on a rotatable carrier (112) in the handle (101) and has a projection (104) entering a recess (105) in the handle (102). The recess allows the handle (102) to move between the closed and intermediate positions without disturbing the carrier (112). Closing the handle (102) drives a drive shaft (110) carrying the wheel (108) through gearing (153), (154), (155). A one-way clutch spring (116) slips when the handles open so that repeated opening and closing of the handles cuts round the can.

16 Claims, 19 Drawing Sheets

Fig. 10A
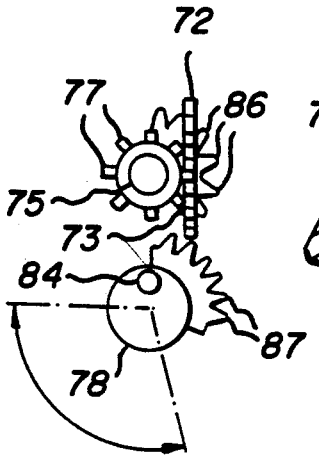
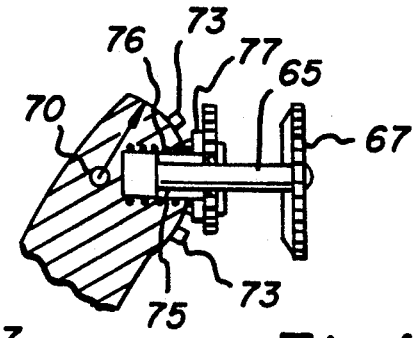
Fig. 10B
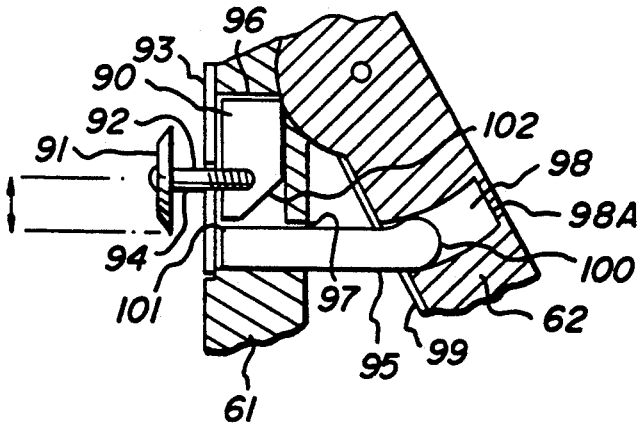
Fig. 11
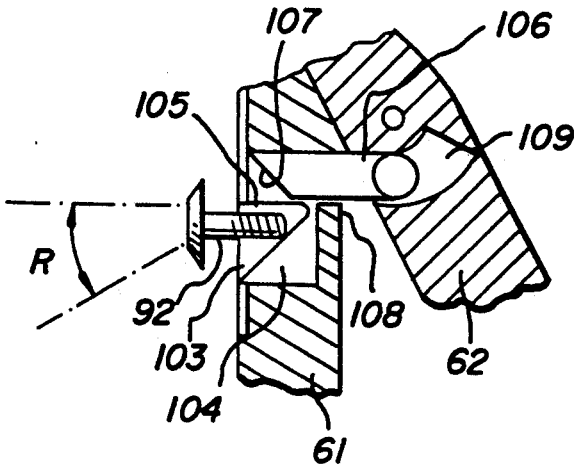
Fig. 12

CAN OPENER

TECHNICAL FIELD

The invention relates to a can opener, and in particular to a manual can opener of the kind comprising a pair of handle members pivoted together.

A well-known manual can opener of this kind comprises a pair of handle members pivoted together at one end and carrying respectively a serrated drive wheel and a cutting element in the form of a cutting wheel with a circular blade. If the handle members are open, i.e. there is a prescribed angle between them, the drive wheel and cutting wheel are separated from one another and can be applied to lie on opposite sides of a rim of a can. On closing the handle members together the drive wheel and the cutting wheel are brought to a position where they engage the rim of the can on opposite sides, i.e. they nip the can and can be said to be in the nip position. In this position the serrated wheel engages the rim and the cutting wheel penetrates a wall of the can. The drive wheel is mounted on a shaft which can be turned by the fingers by means of a butterfly plate mounted thereon. If the drive wheel is so rotated it will travel round the can and in so doing will cause the cutting wheel to cut through an equivalent portion of the can wall.

In such an opener the positional relationship of the wheels is matched to that of the handle members. When the handle members are closed, i.e. there is a minimum angle between them, the wheels are in the nip position. When the handle members are open, i.e. they have a prescribed angle between them, then the wheels are separated i.e. they are in the non-nip position. However, in this specification this simple conformity does not apply. In consequence in this specification the terms "open" and "closed" are to be understood as relating to the angular disposition of a pair of pivoted handle members, and the terms "nip" and "non-nip" are to apply to the relative positions of a cutting element wheel and a drive wheel.

In the known can opener described above the user needs two good hands. One hand is required to close the handle members and keep them closed to maintain the nip position; the other hand is required to turn the drive wheel. Such a can opener is of limited value to an incapacitated person with the use of only one good hand, the other having only limited power or capacity.

BACKGROUND ART

The need for a manual can opener capable of being operated by such a person has been recognised in the past. In the UK Patent Application GB 2161449A there is disclosed a can opener operable by a single hand. In essence this comprises a main handle member on which a cutting wheel is slidably supported, a second handle member pivoted to the main handle member and operable to effect rotation of a drive wheel through a one-way ratchet mechanism, and a third handle member or lever pivoted to the main handle member and operable through the agency of a toggle mechanism to cause the cutting wheel to slide into and out of the nip position. One pair of the three handle members is required for bringing the cutting wheel into the nip position, and a different pair for effecting the cutting operation. This opener is, therefore, of complex construction, is comparatively expensive to manufacture and is not simple to use.

SUMMARY OF THE INVENTION

According to one aspect of the invention a can opener comprises first and second handle members pivotally connected at one end to be relatively rotatable about an axis between an open position in which a prescribed angle exists between them and a closed position in which a minimum angle exists between them, a drive shaft rotatable within the first handle member, a drive wheel having a serrated periphery secured to one end of the drive shaft, transmission means between the second handle member and the drive shaft, the transmission means including a one-way drive mechanism such that for one direction of rotation of the second handle member relative to the first handle member the shaft is engaged to rotate and for the other direction it is not so engaged a cutting element supported on a cutting element carrier, the cutting element carrier being supported by the first handle member and movable relative thereto between a nip position in which the cutting element and the drive wheel are disposed to embrace a rim of a can and a non-nip position in which there is a distance between these for removal or insertion of a can, inter-engagement means between the first and second handle members such that (a) during initial closing movement of the handle members from the open position to the closed position the cutting element carrier is moved from the non-nip position to the nip position and the cutting element penetrates the can wall, (b) in a following opening of the handle members from the closed position to an intermediate position the cutting element carrier remains in the nip position, (c) in subsequent closing and opening movements of the handle members between the intermediate and closed positions the cutting element carrier remains in the nip position, whereby for either closing or opening movements the drive wheel is rotated around the can and the the cutting element cuts the can.

Conveniently, the inter-engagement means is also such that subsequent to the cutting of the can a full opening movement of the handle members to the open position brings about movement of the cutting element carrier to the non-nip position.

The cutting element may be a stationary blade mounted on its carrier: preferably, however, the cutting element is a cutting wheel pivotally mounted for rotation on its carrier.

In one preferred form of the invention the inter-engagement means between the first and second handle members comprises a projection on the cutting element carrier which projects into a recess in the second handle member, the recess having a first projection engagement surface for engaging and moving the cutting element carrier to the nip position during movement of the handles from the open to the closed position and a second projection engagement surface for engaging and moving it to the non-nip position during movement of the handle members from the closed to the open position.

The transmission means may include gearing to multiply the angular rotation of the drive shaft with respect to the angular movement of the second handle member, thereby reducing the number of squeezing actions necessary to cut round a can.

The invention is readily applicable to the cutting of the cylindrical wall of a can or the rim by handle members moving in a horizontal plane. It is clear that such cutting can also be effected by handles moving in a vertical plane by including in the transmission means gearing to change the drive axis through 90 degrees.

It will also be apparent to one skilled in the art that the invention is applicable to openers which cut the flat top surface of a can.

It will be seen that the invention provides for a can to be opened solely by the operation of a single pair of handle members, which provides for both the closing of the nip and the rotation of the drive wheel.

BRIEF DESCRIPTION OF THE DRAWINGS

Embodiments of the specification will now be described, by way of example only, with reference to the accompanying drawings in which:

FIG. 10A is a view of parts of the embodiment of FIG. 9A;

FIG. 10B is a further view of parts of the embodiment of FIG. 9A;

FIG. 11 shows a modification of part of the embodiment of FIG. 9A;

FIG. 12 shows a further modification of the embodiment of FIG. 9A;

MODES OF CARRYING OUT THE INVENTION

Figure 3B:
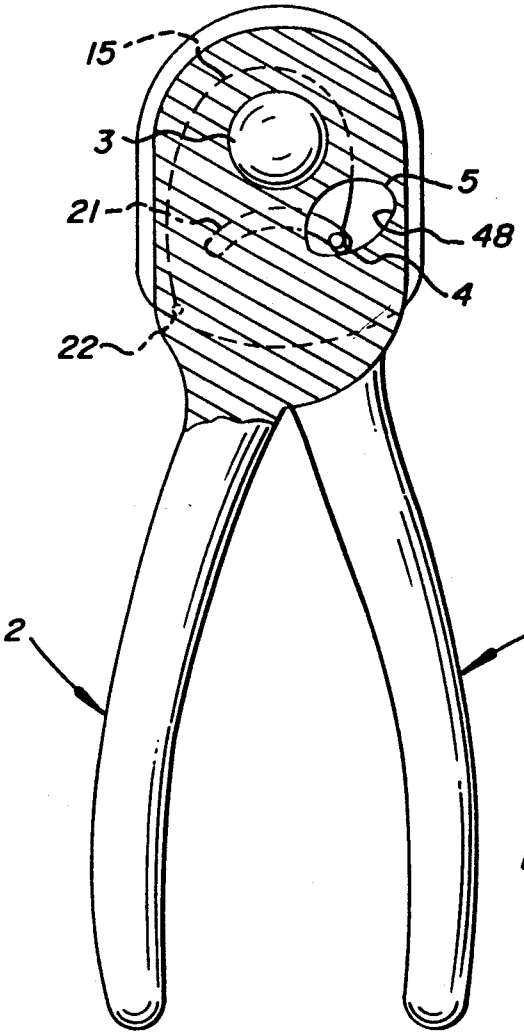
FIGS. 3A and 3B are views similar to FIGS. 1A and 1B but showing the opener in a closed position.
Figure 3A:
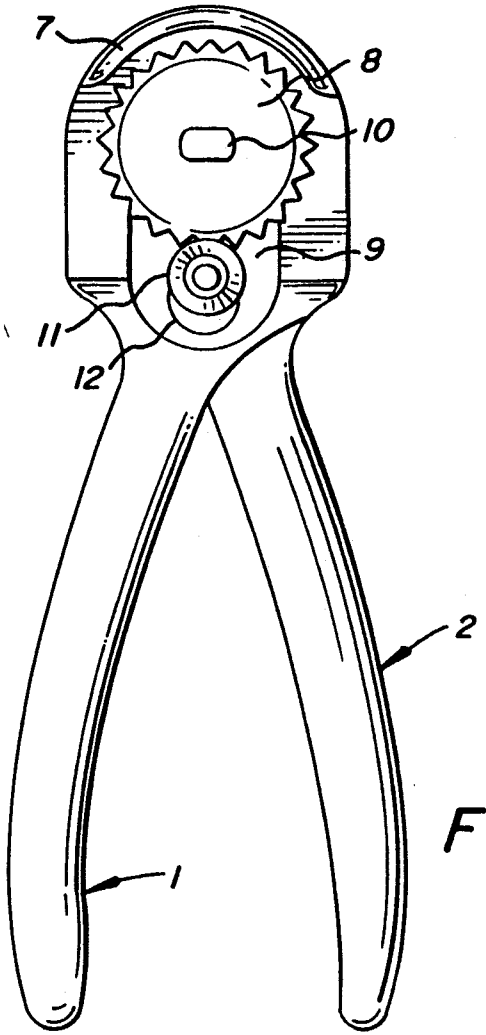
Figure 4:
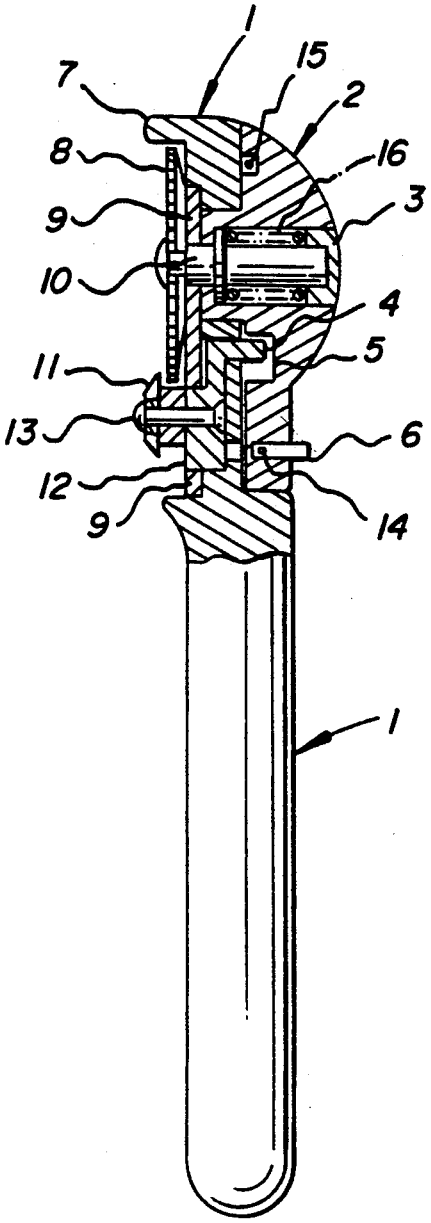
FIG. 4 is a cross-sectional view of the opener in the closed position.
Figure 5A:
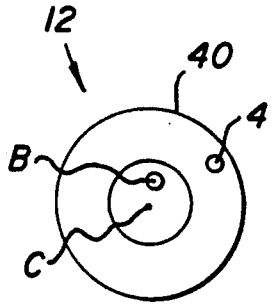
FIG. 5A is a plan view of part of the opener of FIGS. 1A to 5.
Figure 5B:
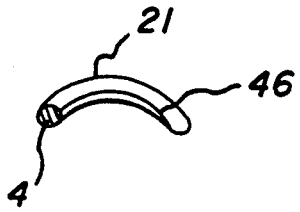
FIG. 5B shows a modification of a part of the opener of FIGS. 1A to 5.
Figure 5:
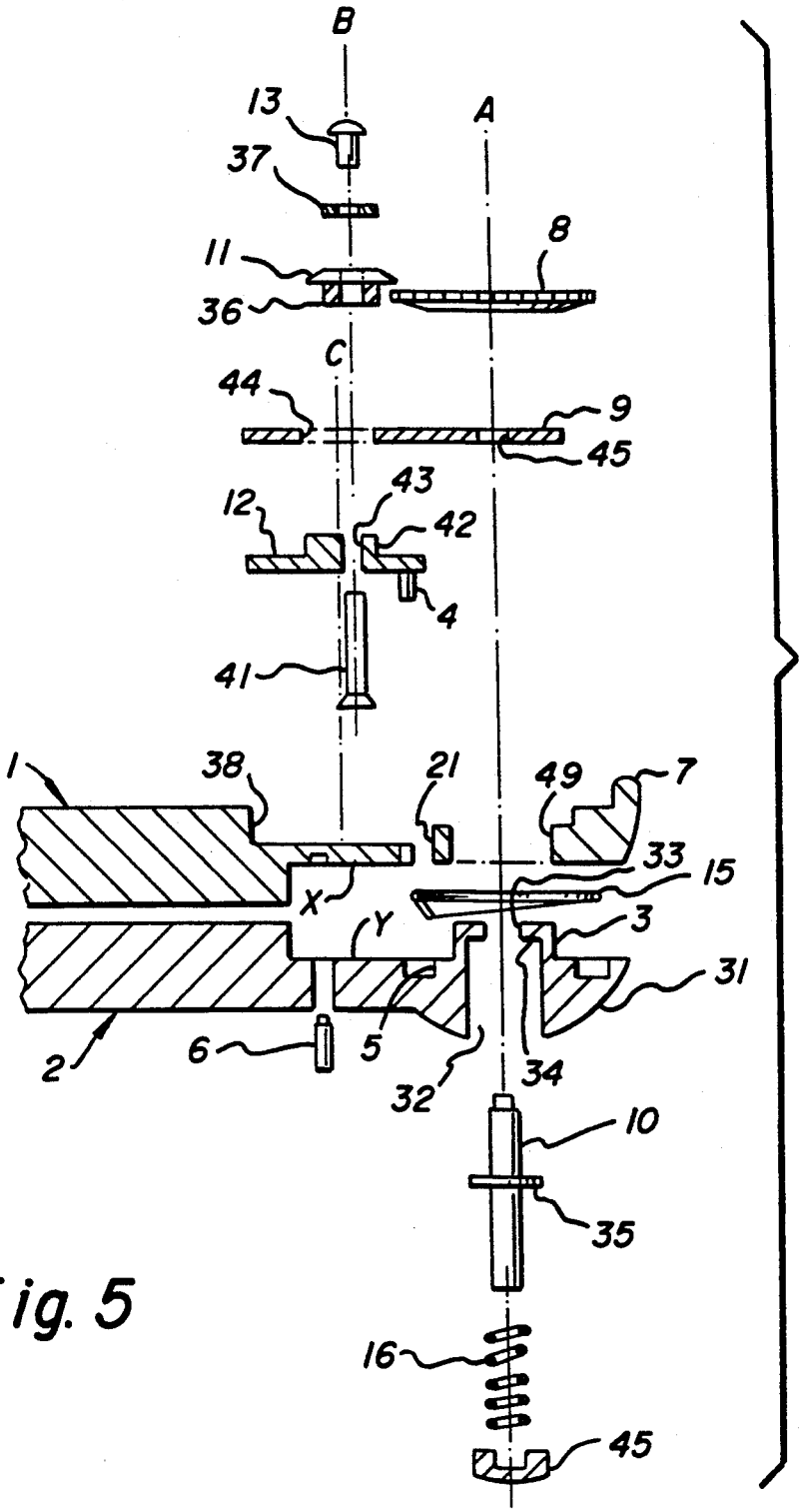
FIG. 5 is an exploded diagram of the principal features of the opener of FIGS. 1A to 4.

As shown in FIGS. 1A to 5 a can opener comprises a lower handle member 1 and an upper handle member 2 arranged for relative rotation about an axis A (FIG. 5) which can be effected by one hand. The terms "upper" and "lower" pertain to the positions of the handle members when the opener is applied to a cylindrical flat-ended can standing upright on a horizontal surface prior to opening. The pivoting ends of the handle members 1 and 2 have planar surfaces X and Y respectively perpendicular to the axis A. These surfaces, although shown separated in the exploded diagram of FIG. 5, are closely adjacent in the assembled can opener. It will also be clear that the parts of the handle members remote from the axis A, which are shown separated in FIG. 5, will in the assembled opener overlie one another when viewed from the side.

As best seen in FIG. 5 the pivoting end of the handle member 2 has a thickened portion 31 in the direction of the axis A providing a dome-shaped outer contour. On the inner side of the handle member 2 opposite to the portion 31 and upstanding from the surface Y there is provided a boss 3 of circular cross-section whose axis defines the axis A. The boss 3 is received in a circular hole 49 in the handle member 1 and provides a bearing surface for the relative rotation of the handle members 1 and 2 about the axis A.

Coaxially within the boss 3 there is provided a through bore having a wider outer part 32 and a narrower inner part 33 separated at a shoulder 34. The inner part 33 acts as a bearing surface for a drive shaft 10 which is coaxially disposed in the bore and has a flange 35 slidingly abutting the shoulder 34.

A drive wheel 8 having a serrated outer periphery is secured to the lower end of the drive shaft 10 by any suitable means (not shown). At the upper end of the drive shaft 10 a one-way clutch in the form of a helical spring 16 is disposed between the shaft 10 and the outer bore part 32, the arrangement being such that for one direction of rotation the handle member 2 engages and drives the shaft 10, and for the other direction of rotation it slips relative to the shaft. An end-cap 45 having an interference fit in the bore part 32 is provided and may provide means for securing one end of the spring 16.

The handle member 1 has a circular recess 38 to receive a cutting wheel carrier comprising a plastics wheel 12. The wheel 12, which is rotatable about a central axis C, has an outwardly-directed centrally disposed boss 42 and an inwardly-directed projection 4 at its periphery. Offset from the centre of the boss 42 is an aperture 43 which receives a cutting wheel spindle 41 whose axis defines an axis B. The arrangement is such that the axes A, B and C are parallel to one another and generally perpendicular to the mid-plane of the handle members 1 and 2.

Disposed above the plastics wheel 12 is a plate 9 provided with apertures 44, 45, to receive and provide bearings for the boss 42 and drive shaft 10 respectively. A cutting wheel 11 is freely mounted on the spindle 41 by a washer 37 and rivet 13. The cutting wheel comprises a circular metal blade, and coaxially therewith a sleeve 36 of fibre, plastics or other suitable material, is so arranged that in operation of the can opener a rim of the can is engaged between the drive wheel 8 and the sleeve 36.

As best seen in FIG. 5A which shows a plan view of the plastics wheel 12, the projection 4 is angularly offset from the radius containing the axes B and C. In FIG. 5 for convenience this projection 4 has been shown, but it should be understood that it lies out of the plane of the paper.

As shown in FIG. 5 the cutting wheel 11 and drive wheel 8 are close to one another in a position where they would effect a nip on a can rim placed between them. By virtue of the eccentric disposition of the cutting wheel spindle axis B relative to the cutting wheel carrier axis C, rotation of the cutting wheel carrier 12 about its axis C will vary the position of the cutting wheel spindle axis B relative to the axis A. It will be apparent, therefore, that the cutting wheel 11 can be brought into the nip position shown in FIG. 5 by rotation of the wheel carrier 12 in one direction about its axis C, and carried away from it by rotation in the other direction.

The projection 4 on the cutting wheel carrier 12 passes through an arcuate aperture 21 in the handle member 1 and is received in a kidney-shaped recess 5 in the handle member 2. One end of a spring 15 is attached to the projection 4 and its other end is connected to an anchorage 22 (FIG. 1B) in the handle member 2, the action of the spring being to bias the handle members apart. An outstanding arcuate portion is provided on the handle member 1 to act as a spacer.

In order to lock the handle members 1 and 2 together in the closed position when not in use, a locking pin 6 is mounted within a through hole in the handle member 2 by a bowed spring 14 (FIG. 4). In the closed position the pin may be pushed against the action of the spring 14 to engage an aligned recess in the handle member 1. The action of the spring 15 holds pin 6 frictionally in place and the handle members together. A slight squeezing on the handle members releases the holding friction on pin 6 and thus allows the spring 14 to retract the pin 6 and permit the handle members to open.

Figure 1A:
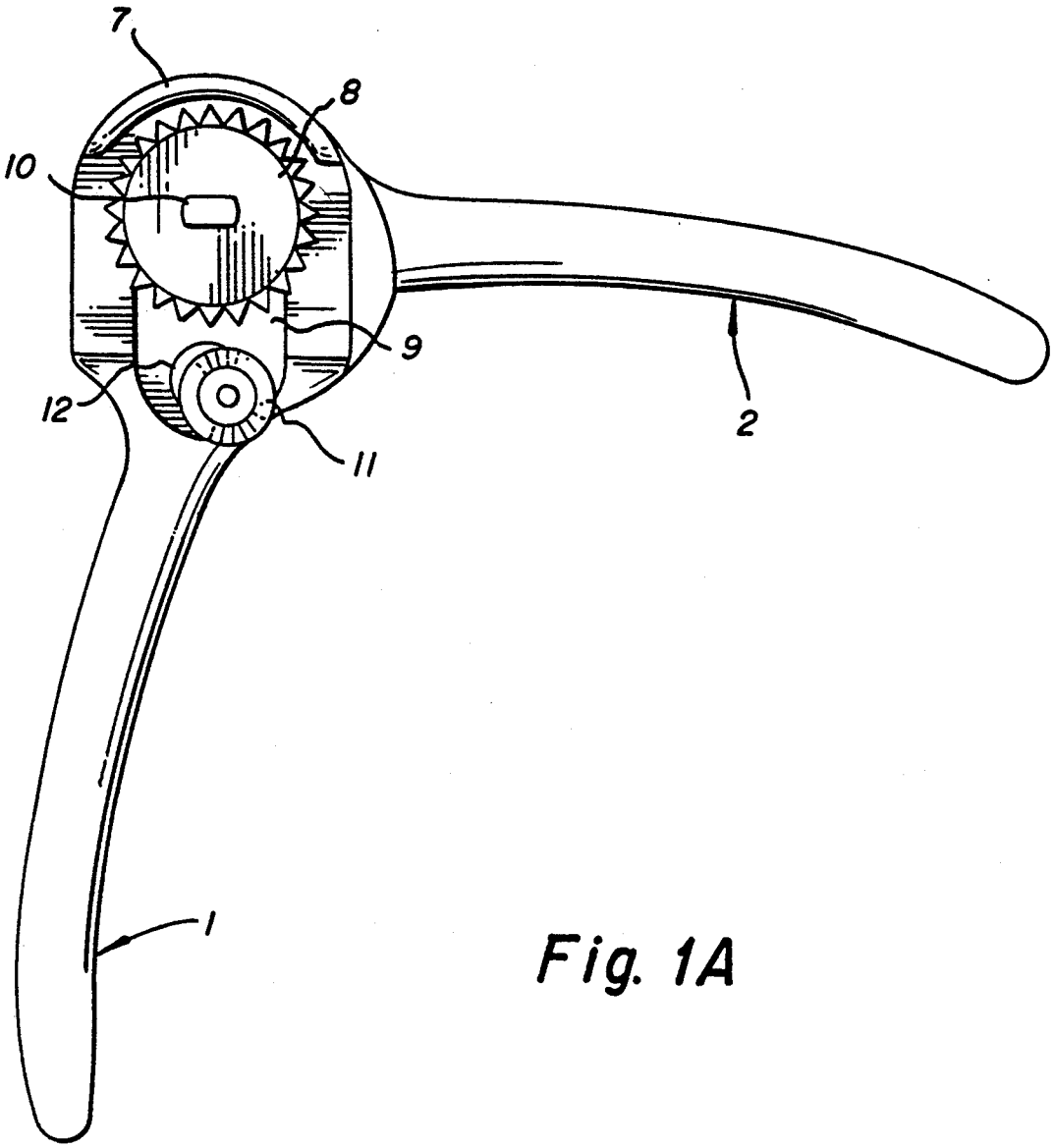
FIG. 1A is a view of a first embodiment of a can opener according to the invention as seen from below and with the opener in an open position.
Figure 1B:
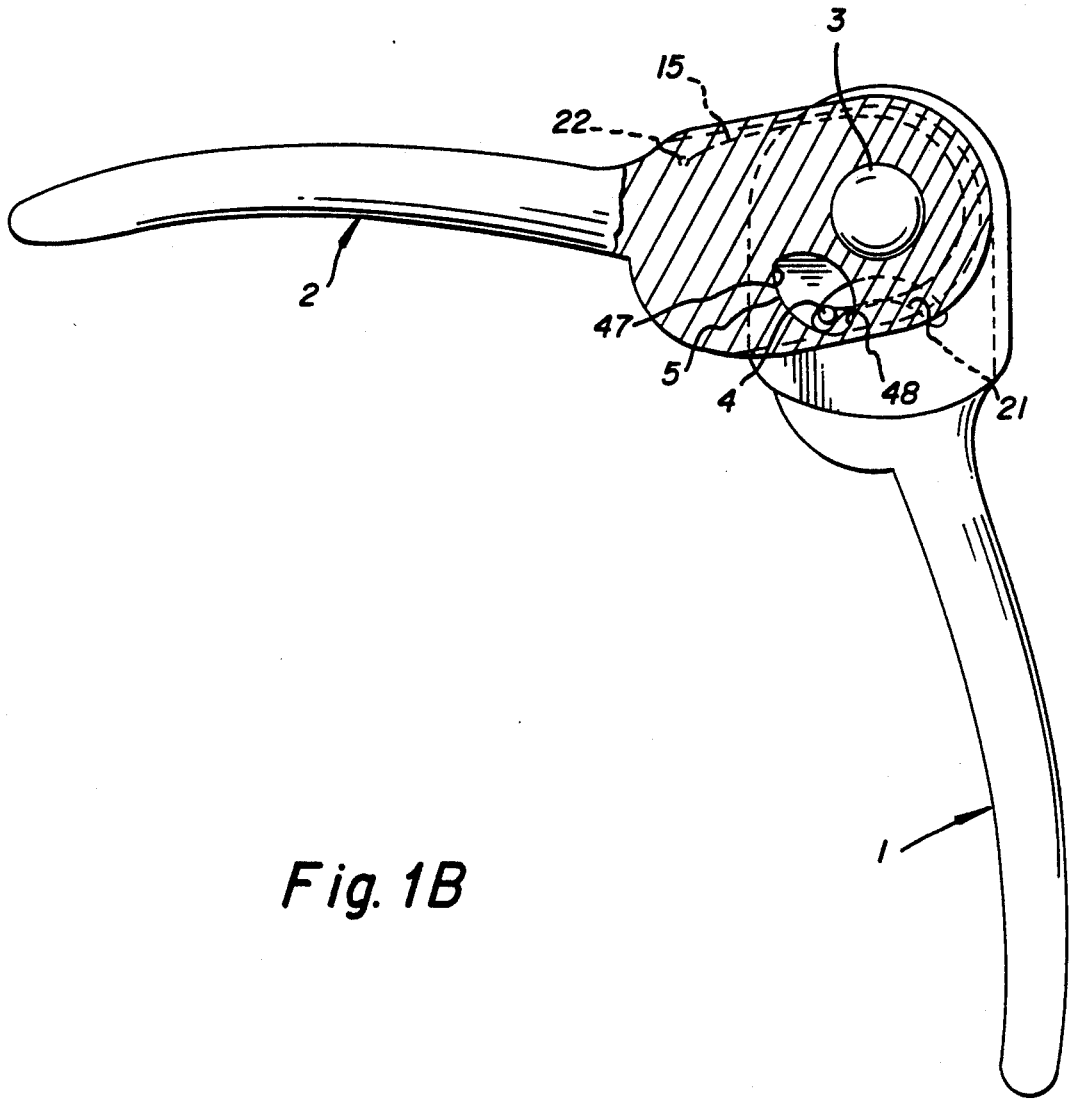
FIG. 1B is a view of the opener of FIG. 1A seen from above with certain features omitted and with the positions of certain hidden features shown in order to aid in the understanding of the invention.

As best seen in FIGS. 1B and 3B parts of the inner periphery of the recess 5 provides projection engagement surfaces 47 and 48 whose purpose will be explained hereafter in the specification.

The operation of the can opener will now be described with particular reference to FIGS. 1 through 5A. FIGS. 1A and 1B show an open position in which the angle between the handle members is a maximum and the cutting wheel 11 is distanced from the drive wheel 8.

With the opener in this position it may be applied to a can in which a planar top of the can is joined to a cylindrical wall by a seam forming a rim. With the handle members disposed generally horizontally above the can the opener can be arranged so that the drive wheel lies inside the rim and the blade of the cutting wheel is disposed so as to cut through the cylindrical side wall of the can.

If now the handle members 1 and 2 are squeezed together a position will be reached in which the projection engaging surface 47 of the recess 5 (FIG. 1B) meets the projection 4 which lies in its path. As the closing of the handle members continues the surface 47 moves the projection 4 to the right (FIG. 1B) causing the cutting wheel carrier 12 to rotate about its axis C and the cutting wheel to move towards the driving wheel 8. This action continues until the projection 4 reaches an end stop position formed by the end of the aperture 21. The position is thus reached when the cutting wheel 11 is in the nip position and the handle members are together in the closed position as shown in FIGS. 3A, 3B, 4 and 5. In the latter stages of this squeezing action the leverage of the handle members 1 and 2 supplies a force which is sufficient to ensure that the cutting wheel blade pierces the material of the can to initiate the cut.

During this first squeezing action the spring 15 is first constrained and then relaxed. It thus acts as an over-centre spring to effect an over-centre or snap-action on the projection 4 to urge this towards and cause it to remain in its final end-stop position defined by the end of the arcuate aperture 21.

Figure 2A:
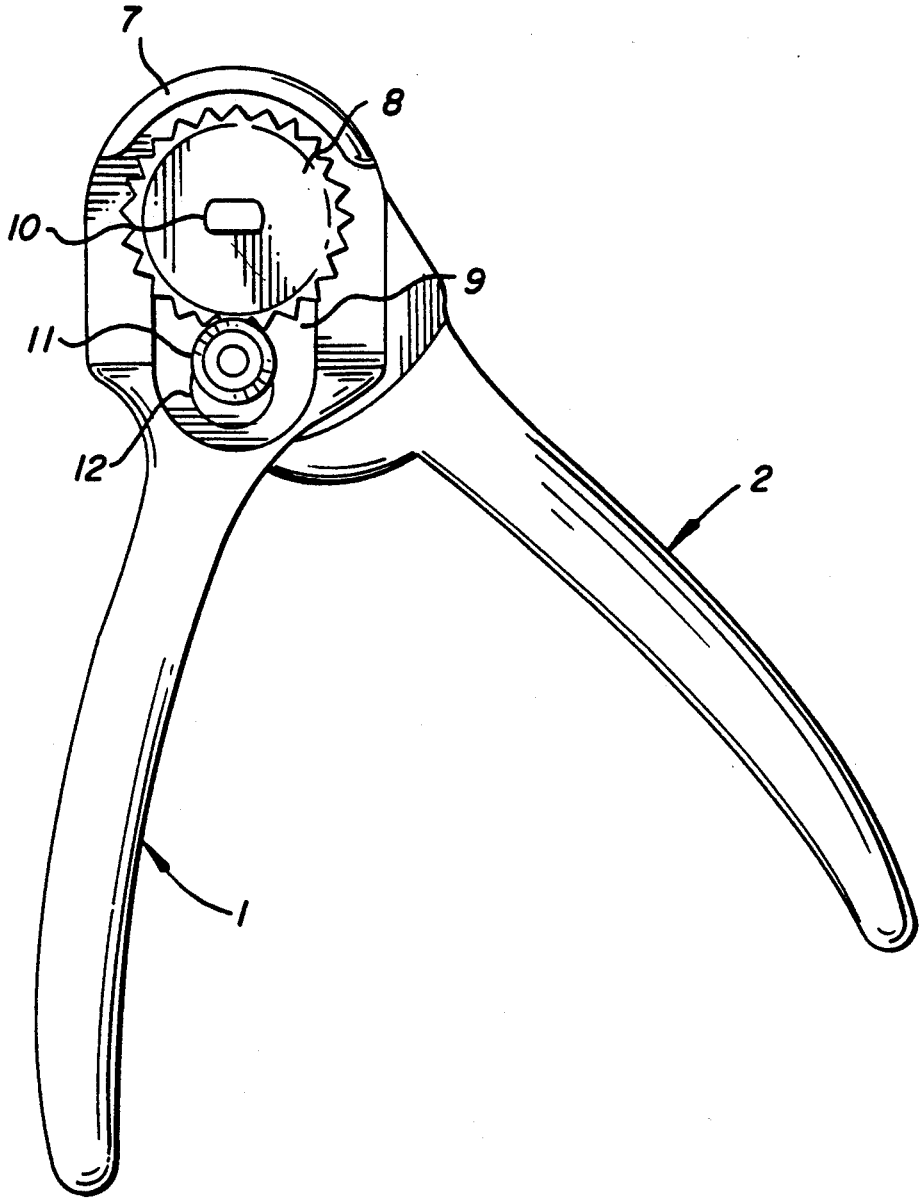
FIGS. 2A and 2B are views similar to FIGS. 1A and 1B but showing the opener in an intermediate position.
Figure 2B:
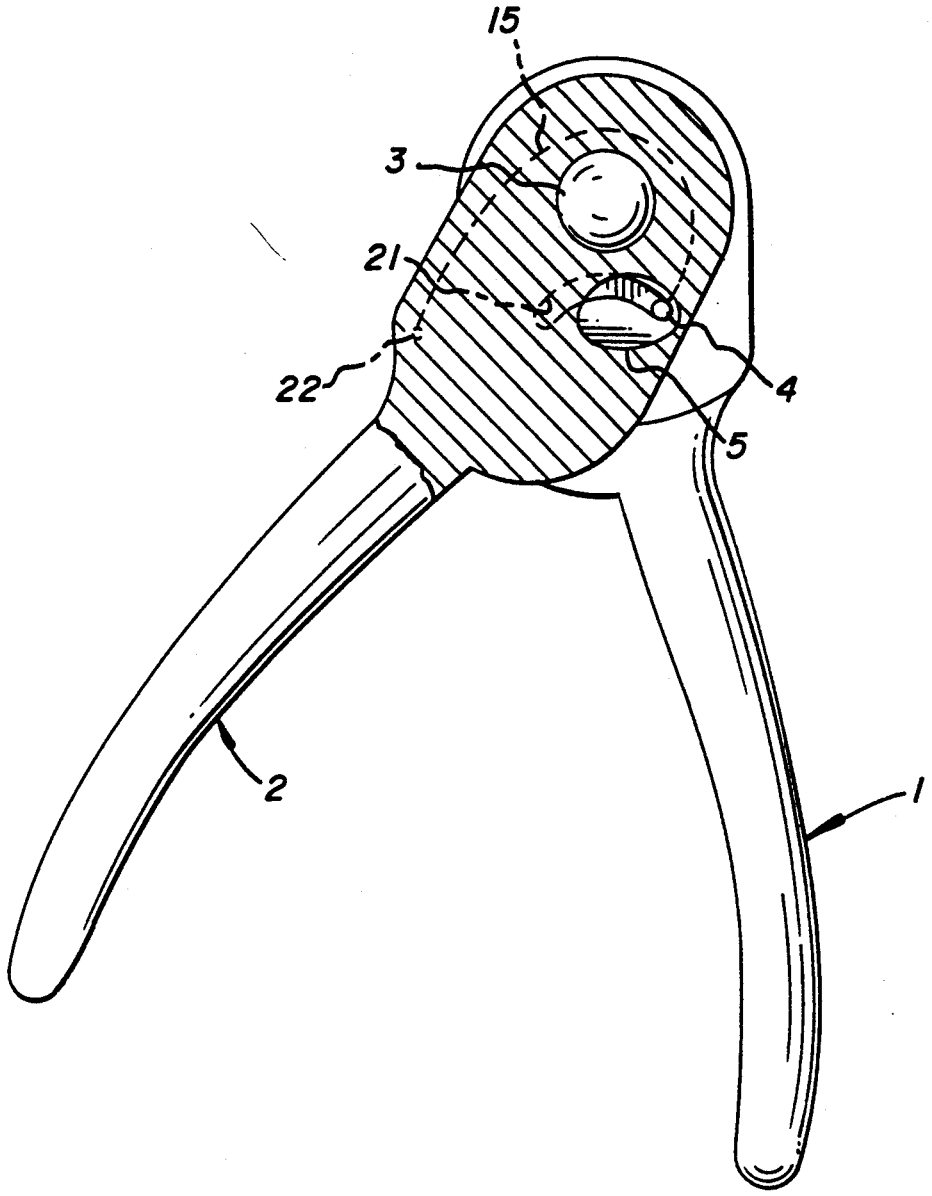

Relaxation of the grip on the handle members by the user allows these to separate under the action of the spring 15 until the second projection engaging surface 48 of the recess 5 contacts the projection 4 at an intermediate position of the handle members as shown in FIG. 2B. During this movement since the positions of the projection 4 and the cutting wheel carrier 12 of which it forms a part remain unchanged in the handle member 1, the cutting wheel 11 retains its position relative to the drive wheel 8 and the nip on the can is maintained. Also during this movement the one-way clutch spring 16 allows slip between the drive shaft 10 and the handle member 2.

If now the handle members are again squeezed together against the action of the spring 15 the one-way clutch spring 16 operates to cause the drive wheel 8 to rotate. Since the serrations of the wheel 8 are engaged with the can the opener is driven round the can and the material of the can is cut by the cutting wheel 11. Repeated squeezing actions will effect continual cutting round the can. During this repeated action the projection 4 is always disposed within the area of the aperture 5 so that the wheel carrier 12 is not displaced within the handle member 1 and the nip on the can is not lost.

To release the opener from the can the handle members are forced apart from the intermediate position of FIG. 2B to the open position of FIG. 1B. The second projection engaging surface 48 (FIG. 3B) of the recess 5 moves the projection against the action of spring 15 to a second end-stop position defined by the left-hand end of the arcuate aperture 21 (FIG. 1B). During this movement the cutting wheel carrier 12 is rotated about its axis C to displace the cutting wheel 11 and release the nip on the can.

In the embodiment described above the single spring 15 serves two purposes; (a) as a reaction spring to open the handle members during the cutting procedure, and (b) as an over centre spring to maintain the projection 4 in its end-stop positions.

In an alternative arrangement these two functions may be performed by separate springs. As shown in FIG. 5B a bowed leaf spring 46 may be disposed adjacent the inner arcuate surface of the aperture 21 to provide an over-centre spring for locating the projection 4 in either of its end positions. With this arrangement the reaction spring 15 need not be attached to the projection 4 but may be connected to any convenient position in the handle member 1.

It will also be apparent that by arranging for the inner surface of the arcuate aperture to be similar to that of the spring 46 so that the projection bears against it, the resilience of the material of the handle member 1 can be utilized to act as the over-centre spring, whereby the spring 46 may be dispensed with. Alternatively, the outer surface of the arcuate aperture may be formed to provide the over-centre resilience.

It will also be clear that any mutually engaging surfaces of the handle member 1 and the wheel carrier 12 may be shaped or otherwise modified to provide increasing frictional engagement between them in moving from the non-nip to the nip position. Providing that there is sufficient friction to resist involuntary relative movement between these members when in the nip position, the provision of an over-centre mechanism is not be necessary.

In the embodiment described above the aperture 21 is shown as arcuate, conforming to the locus of movement of the projection 4 which is determined by the wheel carrier 12. However, except where a surface of the aperture is being utilized to provide resilience or frictional resistance, the precise shape of this aperture is not significant, although it must provide suitably positioned end-stops and a free passage for the projection 4.

As described above the recess 5 is kidney-shaped, however, it is clear that if this recess provides suitable projection engaging surfaces 47 and 48 and does not impede the projection 4 during the cutting procedure its precise shape is not significant.

As shown the recess 5 is a blind recess. However, it may be formed as a through recess in the handle member 2 and the projection 4 may extend completely through and beyond the handle member 2. In these circumstances the extended projection 4 may be utilized in effecting or aiding the opening of the nip after cutting is completed by pressure with a finger or thumb.

In the embodiment above the handle members 1 and 2 are shown as curved and are recessed to provide the surfaces X and Y. However, they may be of any suitable shape; in particular they each may be of generally rectangular parallelepipedal shape and be of equal sizes so that when in the closed position and viewed from above one handle member completely and exactly overlies the other.

The spacer 7 may be omitted and the components of the opener be of suitable dimensions so that the opener may be used to cut not only the cylindrical wall of a can but also the flat top.

Whereas in the arrangement above the cutting wheel carrier is a wheel supported for rotation on the handle member 1, in an alternative arrangement the cutting wheel carrier could be in the form of a crank member rotatable in a cylindrical bearing in the handle member 1.

The invention also embraces an arrangement wherein the cutting wheel carrier does not rotate but slides on the handle member 1 into and out of the nip position.

A second embodiment of the invention will now be described with reference to FIGS. 6, 7A, 7B, 8A and 8B. Features similar to those described above are accorded the same references and will not be further described in detail.

In the embodiment described above with reference to FIGS. 1 through 5, the cutting wheel carrier 12 supported by the handle member 1 comprises a plastics wheel which is mounted for rotation about an axis of rotation C which is parallel to the axis of rotation A of the handle members 1 and 2.

Figure 7A:
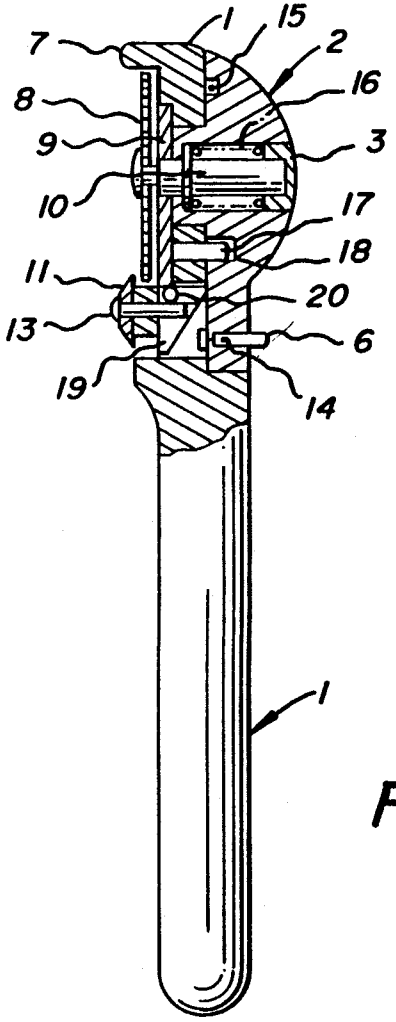
FIG. 7A is a cross-sectional view of the opener of FIG. 6 with the opener in the closed position.
Figure 6:
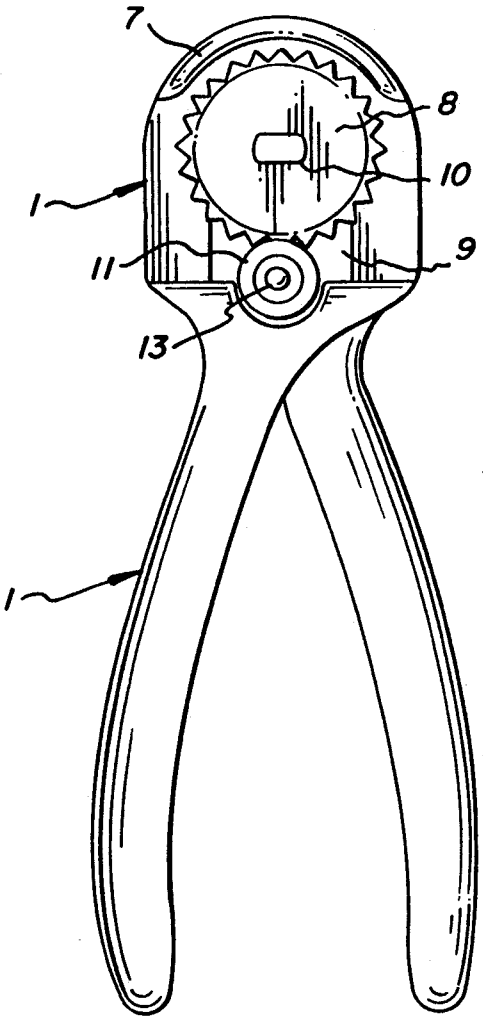
FIG. 6 is a view of a second embodiment of a can opener according to the invention as seen from below and with the opener in a closed position.
Figure 7B:
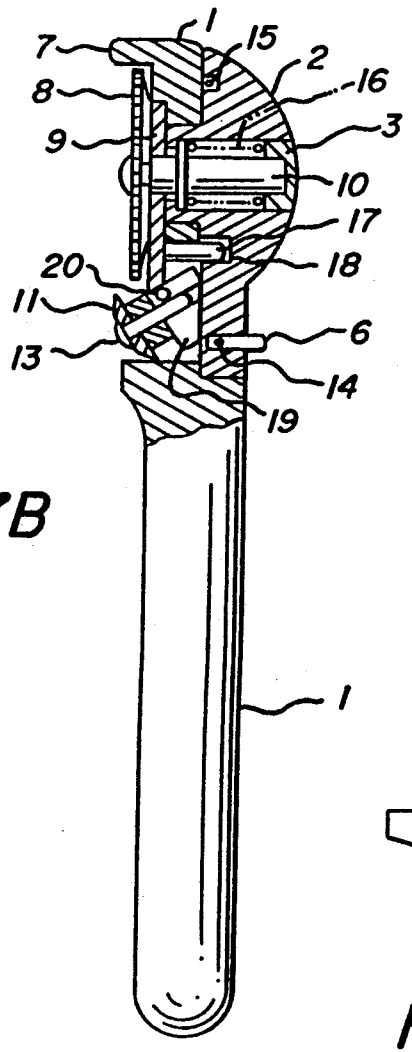
FIG. 7B is a view similar to that of FIG. 7A with the opener in an open position.

In the embodiment of FIGS. 6 through 8B a cutting wheel carrier supported in a recess in the handle member 1 comprises a plastics block 19 mounted for rotation on a spindle 20 having an axis of rotation perpendicular to the axis of rotation of the handle members 1 and 2 as best seen in FIGS. 7A and FIG. 7B.

As will be apparent from FIG. 7B the recess in the handle member 1 is sufficiently large to allow the the carrier block 19 to tilt downwards (as shown). In this position the cutting wheel spindle is disposed at an angle to the drive shaft 10, and a space exists between the cutting wheel 11 and the drive wheel 8 which is sufficient to receive the rim of a can.

Rotation of the carrier block 19 from the non-nip position of FIG. 7B to the nip position of FIG. 7A is effected by a wedge-shaped member 17 slidably mounted in the handle member 1 on suitable means (not shown). The wedge-shaped member 17 is provided with a projection 51 which passes through a linear aperture 50 in the handle member 1 and projects into a kidney-shaped recess 18 in the handle member 2. The recess 18 provides projection engagement surfaces 52 and 53 at opposite ends similar to the surfaces 47 and 48 in the previous embodiment. The lower face of the wedge-shaped member 17 bears on the upper surface of the block 19. The end of a spring such as spring 15 of the previous embodiment is attached to the projection 51 and to a suitable anchorage in the handle member 2.

Figure 8B:
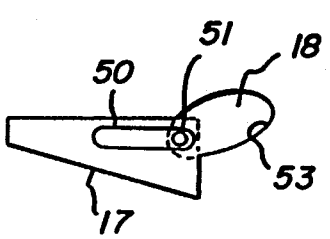
FIG. 8B is a view similar to FIG. 8A with the opener in the open position.
Figure 8A:
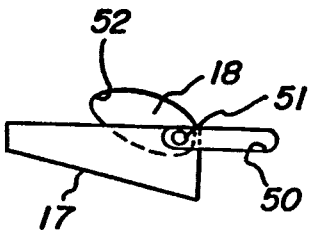
FIG. 8A is a diagrammatic view of parts of the opener of FIG. 6 in the closed position.

In operation, in moving the handle members from an open position (FIGS. 7B and 8B) to a closed position (FIGS. 7A and 8B) the handle member 2 will reach a position where the projection engagement surface 53 will engage the projection 51 on the wedge shaped member 17. Continued movement will cause the surface 53 to push the projection 51 and hence the wedge-shaped member 17 leftwards in FIG. 8B (and outwardly from the paper as viewed in FIG. 7B), this movement ceasing when the projection 51 reaches the end stop position defined by the left hand end of aperture 50, as shown in FIG. 8B. The spring 15 maintains the projection in this end-stop position. Since, during this movement, the bottom surface of the wedge-shaped member 17 is bearing on the upper inner surface of the carrier block 19 this latter is caused to pivot about the spindle 20 bringing the cutting wheel spindle parallel to the drive shaft 10, and hence the cutting wheel into the nip position shown in FIGS. 7A and 8A.

It will be apparent that on relaxing the squeezing action on the handle members these will open under the action of spring 15 until the projection engagement surface 52 abuts the projection 51. Repeated squeezing and releasing by the user will, through the action of the one-way clutch, cause the can to be cut in a manner similar to that described above with reference to FIGS. 1 through 5B.

To release the opener the handle members land 2 are forced apart so that the surface 52 carries the projection 51 to the end-stop position defined by the right hand end of aperture 50 as shown in FIG. 8B. This moves the wedge-shaped block leftwards (FIGS. 8A and 8B) and allows the carrier block 19 to pivot downwards releasing the nip.

A further embodiment of the invention will now be described with reference to FIGS. 9A to 10B inclusive. In this embodiment, in contrast to earlier embodiments, the axis about which the handle members pivot is perpendicular to the drive axis, and the arrangement permits the cutting of the cylindrical wall of a can with the handle members disposed in a vertical plane rather than in a horizontal plane.

Figure 9A:
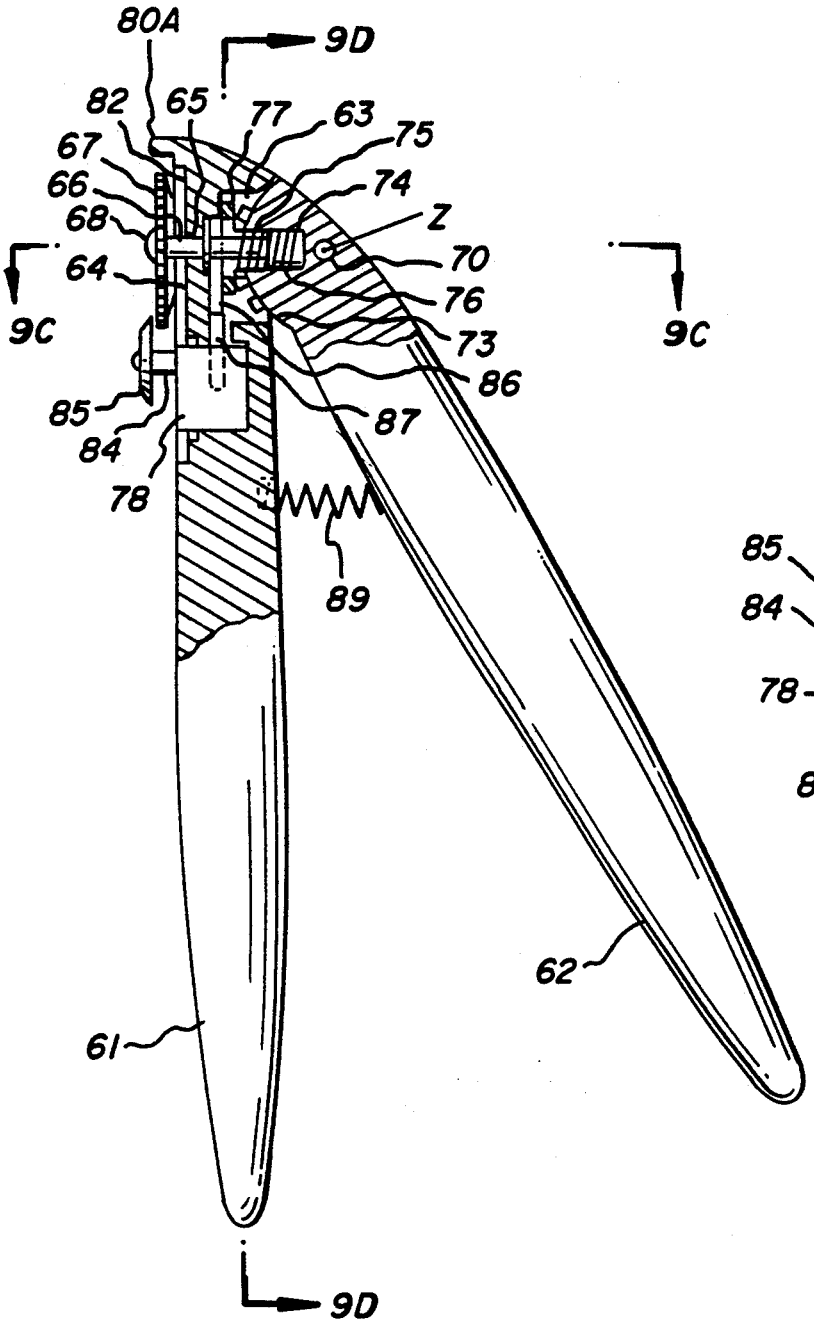
FIG. 9A is a cross-sectional view of a third embodiment of a can opener according to the invention.
Figure 9B:
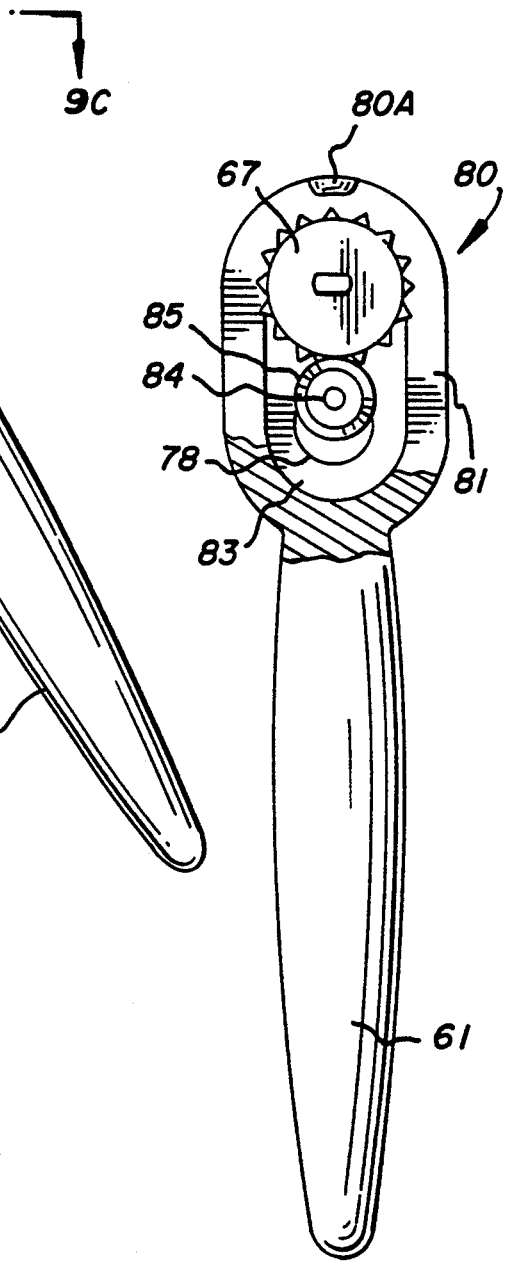
FIG. 9B is a view of the embodiment of FIG. 9A from below.

As shown in FIGS. 9A and 9B an elongate lower handle member 61 and an elongate upper handle member 62 are arranged for relative rotation at one end about an axis 2. The terms "upper" and "lower" refer to the disposition of the members when the opener is applied above a can standing on a horizontal surface prior to opening. Each handle member, remote from its pivoted end, is in the form of an elongate body of generally circular cross-section tapering towards the end.

As shown best in FIG. 9B the pivot end of the handle member 61 is broadened as shown generally at 80 and provides a planar front (i.e. lower) surface 81. Within this surface 81 is a recess having a planar base 82 parallel to the surface 81.

On the rear side of the broadened portion 80 of the handle member 61 is a recess 63 separated from the front recess by a wall 64. A hole 65 in the wall 64 provides a bearing for a drive shaft 66 arranged axially perpendicular to the front surface 81. A serrated drive wheel 67 is secured to the front end of the drive shaft 66 by a rivet 68, or any other suitable means. An optional support leg 80A may be provided on the handle member 61.

Figure 9C:
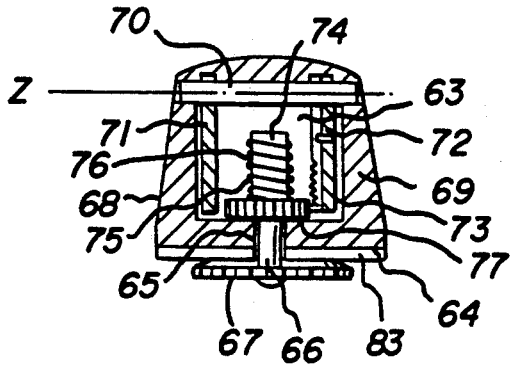
FIG. 9C is a sectional view of the embodiment of FIG. 9A.
Figure 9D:
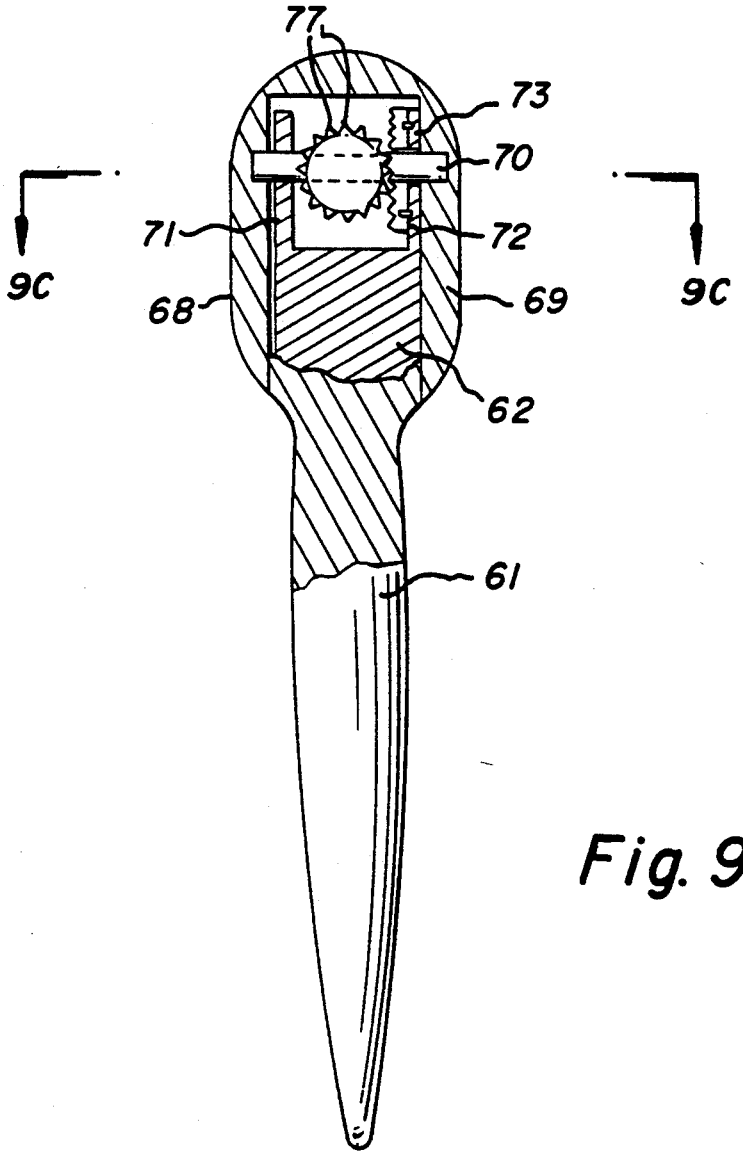
FIG. 9D is a further sectional view of the embodiment of FIG. 9A.

As best seen in FIGS. 9C and 9D, the rear recess 63 is bounded by a pair of integral trunnion plates 68,69, extending rearwardly of the wall 64 and disposed generally parallel to and spaced from the shaft 66. A spindle 70 defining the axis Z and perpendicular to the shaft 66 is mounted between the trunnion plates 68,69.

Also as shown in FIGS. 9C and 9D, the pivoting end of the upper handle member 62 is broadened and has two separated planar extensions 71,72 apertured to receive the spindle 70, which therefore provides the pivot for the two handle members. The ends of the extensions 71,72, are of arcuate shape, and, as best seen in FIGS. 9A and 10B, the extension 72 is provided with teeth 73 forming an arcuate rack whose purpose will be explained hereinafter.

The drive shaft 66 has a portion 74 of increased diameter at its rear end, and a sleeve 75 having an outside diameter equal to that of the portion 74 is disposed forwardly of it. A helical spring 76 acting as a one-way clutch is disposed about the sleeve 75 and shaft portion 74.

The sleeve 75 has teeth 77 which cooperate with the teeth 73 of the arcuate rack of the extension 72. By this means angular movement of the handle member 62 is converted to rotational movement of the sleeve and, through the one-way clutch spring 76, into rotational movement of the drive shaft 66 and drive wheel 67. It will be noted that the toothed rack and toothed sleeve 75 turn the axis of rotation through 90 degrees in a manner which is well-known per se, as, for example, in a crown wheel and pinion.

The interengaging teeth 73 and 77 may be of any suitable form. FIGS. 9C and 9D show a different form from that in FIGS. 9A and 10A. The radius of the arcuate rack is greater than that of the sleeve to provide for a step up in gearing.

As best seen in FIGS. 9A and 9B, a cutting wheel carrier in the form of a wheel 78 is mounted in a recess in handle member 61 for rotation about an axis parallel to the drive shaft 66. Mounted eccentrically on the wheel 78 is a cutting wheel spindle 84, which is also parallel to the drive shaft and upon which is mounted a cutting wheel 85. Thus rotation of the cutting wheel carrier 78 in the handle 61 brings the cutting wheel 85 into or out of the nip position with the drive wheel 67, the nip position being shown in FIGS. 9A and 9B. A front plate 83 disposed in the recess 82 is apertured to provide bearings for the drive shaft 66 and cutting wheel carrier 78.

As shown in FIG. 10A, the sleeve 75 is provided with a group of additional teeth 86 larger than the teeth 77 and engageable with a group of teeth 87 on the cutting wheel carrier 78. (FIGS. 9C,9D do not show the teeth 86) The arrangement is such that on a first closure of the handle member 62 the cutting wheel carrier 78 is moved towards the nip position, first by the teeth 86, 87, and subsequently when these teeth have disengaged, by resilient means, not shown, into a stable locking position. The arrangement is also such that the teeth 86, 87, do not engage on return movement of the handle member 62. To release the nip, means (not shown) move the cutting wheel carrier 78 into a position where the teeth 86,87, engage, so that opening movement of the handle member 62 moves the carrier 78 and releases the nip.

In operation, with the handle members 61,62, in the open position and the opener disposed about the top of an upright can, a first closing movement causes the arcuate rack to turn the sleeve 75 and, by means of teeth 86,87, brings the cutting wheel 85 into the nip position. Relaxation of the manual grip allows the handle members to open under the action of a spring 89. Subsequent closure causes the arcuate rack to turn the sleeve 75 and, as explained above, effect rotation of the drive wheel 67. Repeated closing and opening movements effect the cutting of the can around the cylindrical wall or top of the can.

A modification of the above arrangement is shown in FIG. 11. Except where stated the features are similar to those described with reference to FIGS. 9A to 10B and are not repeated in the following description. In this modification the rotatable wheel carrier is replaced by a slidable block 90 sliding in a longitudinal recess 96 in the handle member 61. Also in this modification the teeth 86, 87, are not required, and the sleeve 75 shown in FIGS. 9C and 9D depicts this situation. The cutting wheel 91 is mounted on a part-threaded spindle 92 which is screwed into the block 90 to be parallel to the drive shaft 66. A front plate 93 is slotted at 94 to permit the passage of the spindle 92. A rod 95 extends between the two handle members 61, 62, the front end of the rod 95 entering the recess 96 through a loosely fitting hole 97. A bulbous rear end 100 of the rod 95 is received in a recess 98 in the handle member 62, and is retained therein by an apertured closure plate 99.

As shown the cutting wheel 91 is in the nip position, and the front end of the rod 95 prevents longitudinal, as shown downward, movement of the block 90. In this position a catch detent (not shown) in the rod 95 engages a recess (not shown) in the handle member 61 to locate the rod in position. Closing and opening of the handle members from this position allows the can to be cut in the manner described above, with the bulbous end 100 traversing the recess 98 and the nip position remaining undisturbed. To release the nip, the handle members are separated to a fully open position whereby the plate 99 engages the bulbous end 100 to withdraw the rod 95 rearwardly. The over-size aperture 97 permits the catch detent to be released and the rod moves sufficiently far to allow the block 90 to slide downwardly to a non-nip position.

To reset the nip position the handle members are closed and a rear surface 98A of the recess 98 pushes the rod 95 forward. A rounded front edge 101 of the rod engages a cam surface 102 on the block 90 moving this upwardly along the recess 96 until the nip position of FIG. 11 is reached.

A further modification is disclosed in FIG. 12 which differs from that of FIG. 11 essentially in that the cutting wheel carrier is a pivoted member. As shown a cutting wheel carrier 103 has a generally triangular cross-section and is disposed in a front recess 104 in a handle member 61. The carrier is pivoted about a spindle 105 disposed perpendicularly to the cutting wheel spindle 92 and is capable of rotation through an angle R between nip and non-nip positions. A rod 106 is extends between the recess 104 and a recess 109 in handle member 62 and generally similar to the rod 95 of FIG. 11, but differs in that its front end has a cam surface 107 which can bear against a rounded edge 108 of the cutting wheel carrier 103. In the fully open position the rod 106 is withdrawn sufficiently for the carrier 103 to tilt into a non-nip position. Closing the handle members fully pushes the rod 106 forward and causes the cam surface 107 to tilt the carrier 203 into the nip position. If the handle members are separated, by spring or otherwise, to the position shown in FIG. 12, the nip is retained, and moving the handle members to and fro between this position and the closed position will cut the can as explained hereinbefore.

Figure 13:
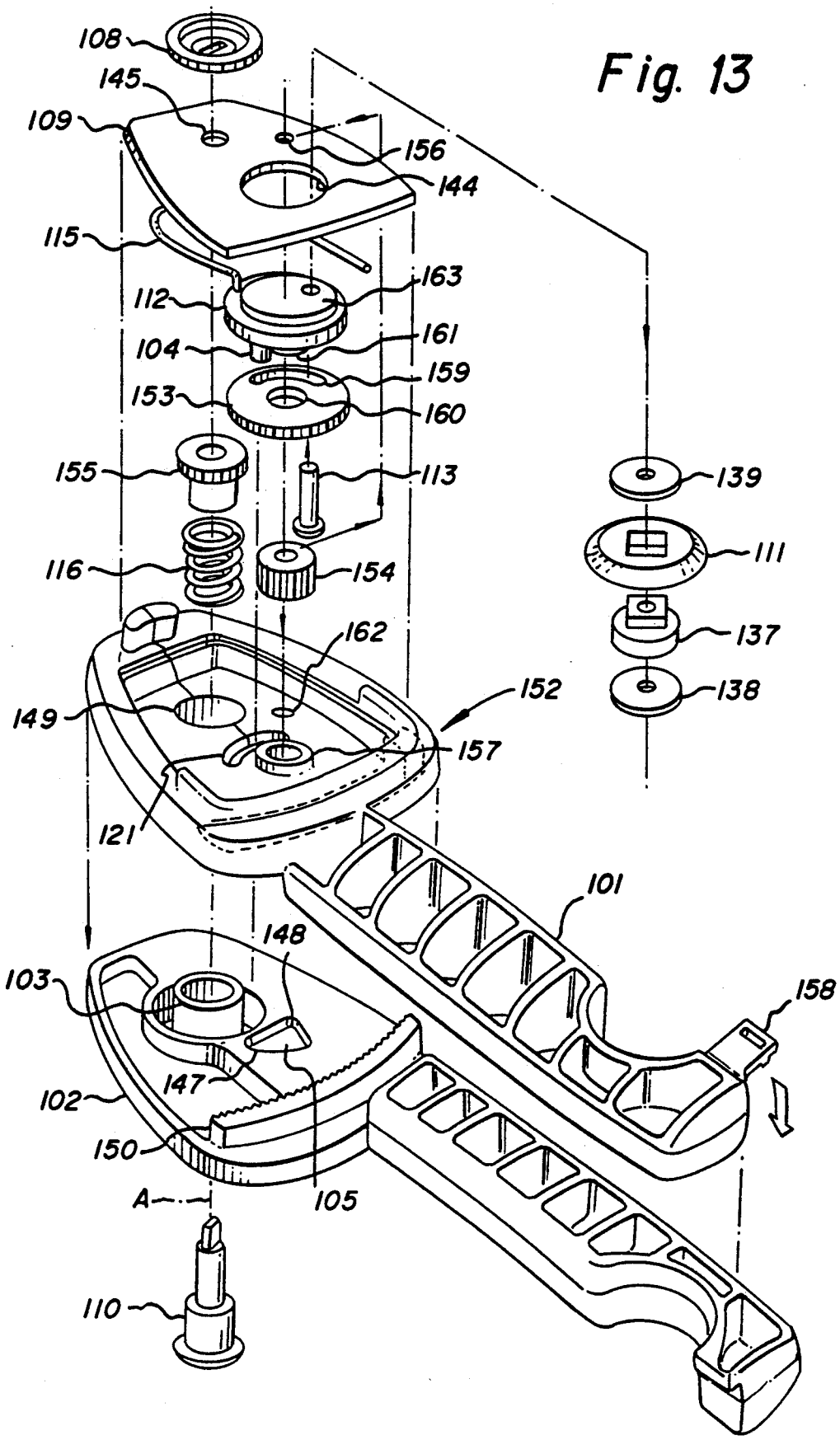
FIG. 13 shows an exploded diagram of a further embodiment of the invention.
Figure 14:
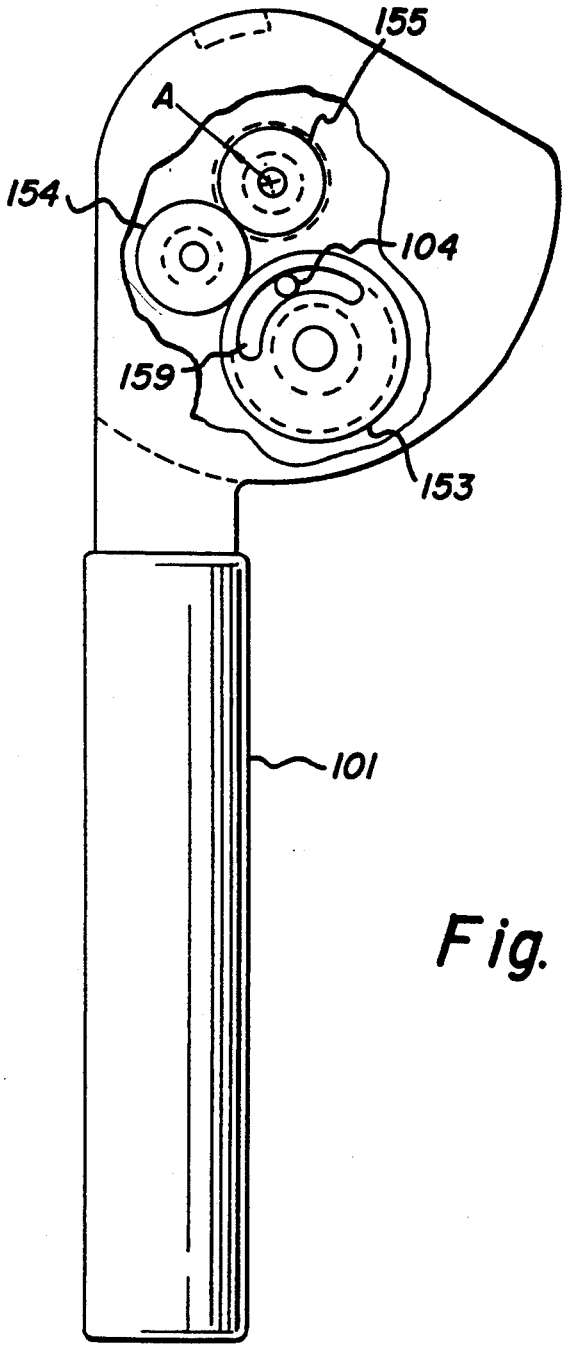
FIG. 14 is a diagrammatic view of parts of the opener of FIG. 13.

A further embodiment will now be described with reference to FIGS. 13 and 14, in which FIG. 13 represents an exploded view of the can opener, and FIG. 14 represents a diagrammatic plan view of gearing associated with the handle member 101. This embodiment is similar to that described with reference to FIGS. 1 through 5, but differs in that it includes gearing to increase the angular rotation of the drive shaft relative to the angular movement of the handle members.

As shown a lower handle member 101 is apertured at 149 to receive a boss 103 of an upper handle member 102, the boss acting as a bearing for relative rotation of the handle members. The handle members have widened portions at their pivoted ends, these portions being of identical plan shape, the handle portions remote from the pivot being disposed on opposite sides of a longitudinal centre line. The lower handle member 101 has a recess which receives parts of the can opener to be described later, and which is enclosed by a plate 109. An aperture 145 in the plate 109 provides a bearing for a drive shaft 110 passing through an aperture in the boss 103 and carrying a drive wheel 108. The plate 109 also provides a bearing aperture 144 for a boss 163 of a cutting wheel carrier 112 having an off-centre spindle 113 on which a cutting wheel 111 and washers 137, 138, and 139 are mounted. The carrier also has a projection 104 which passes through an arcuate slot 121 in the handle member 101 and into a recess 105 in the handle member 102 where it can be engaged by projection engagement surfaces 147, 148.

So far the arrangement is similar to that described above with respect to FIGS. 1 through 5 above, and operates in a similar fashion with the projection engagement surfaces 147 and 148 acting on the projection 105 to rotate the carrier wheel carrier 112 and bring the cutting wheel 111 into or out of the nip position as required.

However, as stated above, this embodiment includes gearing to multiply the drive wheel movement. To this end, the handle member 102 is provided with an arcuate rack 150 which engages with a gear wheel 153. The gear wheel 153 is the first of a train of three gear wheels 153, 154, 155 disposed within the recess in the handle member 101 beneath the plate 109 and arranged as best seen in FIG. 14. The gear wheel 153 is apertured at 160 to rotate freely about a boss 161 on the cutting wheel carrier 112, the boss being engaged in a bearing aperture 157 in handle member 101. A further boss 163 on the opposite side of the carrier 112 rotates within a bearing aperture 144 in the plate 109. The gear wheel 153 has an arcuate slot 159 which is of sufficient length as to ensure no interference with the projection 104 passing through it. The gear 154 turns in bearing apertures 156 in the plate 109 and 162 in the handle member 101. (It will be appreciated that in the view shown in FIG. 13 the axis for the gear 154 lies directly behind that for the the gear wheel 153 and carrier 112, and is not therefore apparent in the drawing) Gear wheel 154 drives a forward direction main drive gear wheel 155. This is apertured to receive a reduced diameter portion of the drive shaft 110 and drives that shaft by means of a one-way mechanism in the form of a helical spring clutch 116 surrounding common diameter portions of the gear wheel and drive shaft. A spring 115 acts similarly to that in the embodiment of FIGS. 1 through 5, and a flap 158 engages a socket in handle member 102 to hold the handle members closed when not in use.

In operation the closing of the handle members from the open position brings about the closing of the nip as explained above, whereby the cutting wheel penetrates the can to initiate the cut. During this movement the gear wheels will rotate. On allowing the handle members to open under the action of spring 115 the gear wheels will again rotate, this time in the opposite direction but the clutch will slip and the drive shaft will not rotate. This opening movement will continue until the intermediate position for the handle members is reached, and during this movement the recess 105 will move relatively to the projection 104, but the latter will not be moved relatively to the handle member 101 and the nip will not be lost. Closure of the handle members will now cause the clutch 116 to be engaged through the rack 150 and gear train 153, 154 and 155, and the drive wheel 108 will rotate causing the cutting wheel 111 to cut a portion of the can. Repeated opening and closing of the handle members from the intermediate position will effect cutting of the can around its periphery. To release the nip the handle members are separated to the fully open position, whereupon the projection surface 148 moves the projection 104 to rotate the cutting wheel carrier 112 and separate the cutting wheel 111 from the drive wheel 108 thereby opening the nip.

It will appreciated that variations from and modifications of the embodiments above may be made without departing from the scope of the invention as defined by the claims.

For example, it will be appreciated that in all the above embodiments rotation of the drive wheel and hence cutting of the can has been effected during closing movements of the handle members. However, it will be clear to one skilled in the art that by providing a one-way mechanism of opposite sense cutting may be arranged to take place on opening movements not closing movements.

In certain embodiments, for example those of FIGS. 1 through 5, and FIGS. 13 and 14, the inter-engagement means comprises a projection on the cutting wheel carrier and surfaces of a recess in the second handle member. It will, however, be clear to one skilled in the art the recess may be provided in the cutting wheel carrier and the projection on the second handle member.

Again, in certain of the embodiments above the projection engagement surfaces have been provided by inside surfaces of a recess, but it is clear that these surfaces might be provided by straight or curved spaced walls of suitable length upstanding from a lower base level.

Yet again, whilst in the embodiments above the one-way mechanism has been provided by a helical spring clutch, other one-way mechanisms might be used, for example a roller clutch, needle bearing clutch, dog tooth clutch or a ratchet mechanism.

Moreover, in the above embodiments a spring has been provided to urge the handle members apart, and clearly any suitable form of spring, such as coil spring, U-spring, leaf spring etc., may be used. It is, however, clear that such a spring might be dispensed with and the handle members provided with finger apertures so that they could be positively moved apart as with an ordinary pair of scissors. Even in this situation a reaction spring could be provided in addition.

Any suitable materials may be used for the component parts described. Conveniently the handle members may be of plastics material or metal, the cutting wheels of metal, the cutting element carrier of plastics material or of metal, and the other parts of plastics material or metal as appropriate.

We claim:

1. A can opener comprising:

first and second handle members pivotally connected to one another at one end to be relatively rotatable about an axis between an open position in which a prescribed angle exists between them and a closed position in which a minimum angle exists between them, a drive shaft rotatable within the first handle member, a drive wheel having a serrate periphery secured to one end of the drive shaft, a transmission means between the second handle member and the drive shaft for transmitting rotational movement of the second handle member relative to the first handle member about the axis to the drive shaft, the transmission means including a one-way drive mechanism such that (a) for one direction of rotation of the second handle member relative to the first handle member about the axis the drive shaft is engaged by the second handle member to rotate the drive shaft and (b) for the other direction of rotation the drive shaft is not so engaged by the second handle member, a cutting element supported on a cutting element carrier, the cutting element carrier being supported by the first handle member and movable relative thereto between a nip position in which the cutting element and the drive wheel are disposed to embrace the rim of a can and a non-nip position in which there is a distance between these for removal or insertion of a can, an inter-engagement mechanism between the first and second handle members including (a) a moving means, actuated by the rotational movement of an initial closing of the handle members from the open position to the closed position, for moving the cutting element carrier from the non-nip position to the nip position so that the cutting element penetrates the can, and (b) a keeping means for keeping, in a following opening of the handle members from the closed position to an intermediate position and in subsequent closing and opening movements of the handle members between the intermediate and closed positions, the cutting element carrier in the nip position, whereby for closing or opening movements of the handle members the drive wheel is rotated around the can and the cutting element cuts the can.

2. A can opener as claimed in claim 1, wherein the moving means is also actuated by a full opening movement of the handle members to the open position from the intermediate position for moving the cutting element from the nip position to the non-nip position subsequent to the cutting of the can.

3. A can opener as claimed in claim 1 in which the cutting element carrier is a wheel.

4. A can opener as claimed in claim 1 in which the cutting element carrier is a rotatable crank.

5. A can opener as claimed in claim 1 in which the cutting element carrier is a slidable member.

6. A can opener as claimed in claim 1 in which the cutting element carrier is a tiltable block.

7. A can opener as claimed in claim 1 in which the moving means comprises a projection on the cutting element carrier which projects into a recess in the second handle member.

8. A can opener as claimed in claim 7 in which the recess has two projection engaging surfaces for engagement with the projection in opening and closing movements respectively.

9. A can opener as claimed in claim 8 in which the recess is kidney-shaped.

10. A can opener as claimed in claim 7 in which the handle members are biased towards the opening position by a spring, and in which the spring is disposed between the projection and an anchorage on the second handle member.

11. A can opener as claimed in claim 1 in which the handle members are biased towards the opening position by a spring.

12. A can opener as claimed in claim 1 in which the one-way drive mechanism comprises a helical spring clutch.

13. A can opener as claimed in claim 1 in which the drive shaft is coaxial with the pivotally connected handle members.

14. A can opener as claimed in claim 1 in which an axis of the drive shaft is perpendicular to the axis of rotation of the handle members.

15. A can opener as claimed in claim 14 in which the transmission means between the second handle member and the drive shaft includes a gear means for changing the rotational movement of the second handle member about the axis to a rotational movement of the drive shaft about the drive shaft axis.

16. A can opener as claimed in claim 1 in which the transmission means between the second handle member and the drive shaft includes a gear means for multiplying a rotational movement of the second handle member transmitted to the drive shaft.

* * * * *